US005924544A

United States Patent [19]

Kwon

[11] Patent Number: 5,924,544

[45] Date of Patent: Jul. 20, 1999

[54] TERMINAL RAIL SYSTEM FOR ESCALATOR

[75] Inventor: Yi Sug Kwon, Kyungsangnam-Do, Rep. of Korea

[73] Assignee: LG Industrial Systems Co., Ltd., Seoul, Rep. of Korea

[21] Appl. No.: 08/861,706

[22] Filed: May 22, 1997

[30] Foreign Application Priority Data

May 25, 1996 [KR] Rep. of Korea ..... 96/17868
Feb. 11, 1997 [KR] Rep. of Korea ..... 97/3946

[51] Int. Cl.[6] ..... B66B 21/00

[52] U.S. Cl. ..... 198/326; 198/332

[58] Field of Search ..... 198/326, 332

[56] References Cited

U.S. PATENT DOCUMENTS 1,610,411 12/1926 Baker ..... 198/332
1,668,644 5/1928 Hocquart et al. ..... 198/332
5,829,570 11/1998 Kwon ..... 198/326

*Primary Examiner*—Joseph E. Valenza
*Attorney, Agent, or Firm*—Birch, Stewart, Kolasch & Birch, LLP

[57] ABSTRACT

A terminal rail system for an escalator includes an escalator step including a step front roller and a step rear roller, an upper guide rail for guiding the step front roller, a lower guide rail for guiding the step rear roller, a semicircular inner casing and outer casing, the inner casing being engaged to the lower guide rail, at a curved portion of the lower guide rail the escalator step changing a proceeding level, and at least one end portion of each of the inner casing and outer casing being separated from a corresponding one thereof for thereby reducing an impact caused by the step rear roller. The terminal rail system flexibly buffers the respective impacts caused by the step rear roller for thereby considerably relieving the vibration and noise.

8 Claims, 5 Drawing Sheets

TERMINAL RAIL SYSTEM FOR ESCALATOR

BACKGROUND OF THE INVENTION

1. Field of the Invention

The present invention relates to an escalator, and more particularly to an improved escalator terminal rail system capable of minimizing noise and vibration caused by an impact resulting from a step rear roller passing through a channel formed in the terminal rail system.

2. Description of the Prior Art

As shown in FIGS. 1 and 2, a conventional escalator includes: a pair of hand rails 1 for concurrently moving along a predetermined track thereof; a step unit 2 for transporting passengers; and a mechanical assembly 3 for driving the hand rails 1 and the step unit 2.

The mechanical assembly 3 includes: a driving unit provided with a motor 4, a speed reducer 5, a driving chain 6, a driving sprocket 7, a first terminal gear 8, a second terminal gear 11, a driving shaft 12 and a terminal rail 13; and a moving unit provided with a plurality of steps 9, a step chain 10, a step rear roller 14, and a step front roller 15.

With reference to FIGS. 3 and 4, the terminal rail 13 is provided with a semicircular inner casing 18 and a semicircular outer casing 19, wherein an end portion of the inner casing 18 is engaged to an upper end portion of a lower guide rail 17.

The thusly constituted conventional terminal rail system serves to guide the step rear roller 15 and is not furnished with an extra device for removing or decreasing noise or vibration, and a generally adopted method therefor is to relieve an escalation impact by simply applying a precise fabrication to the terminal rail 13 so as to maintain a minimum gap between the inner casing 18 and the outer casing 19, through which gap does the step rear roller 15 passes.

The operation of the thusly constituted escalator will now be described.

First, power generated by the motor 4 in the mechanical assembly 3 is transferred to the speed reducer 5. In accordance with driving of the sprocket 7 connected to the speed reducer 5, the driving chain 6 is rendered driven. The first terminal gear 8 sharing a shaft with the driving sprocket 7 operates the step chain 10 being engaged to the steps 9 which circulate between the first terminal gear 8 and the second terminal gear 11.

The step front roller 14 travels along the upper guide rail 16, and the step rear roller 15 travels along the lower guide rail 17, so that when the step 9 reaches to an upper or lower end portion of the escalator, the step rear roller 15 is turned around through a channel formed in the terminal rail 13.

As shown in FIG. 4, at the upper and lower end portion of the escalator, the step front roller 14 is turned around and engaged to the terminal gear 8, and the step rear roller 15 is turned around along the terminal rail 13. At this time, the step rear roller 15 travels being attached to an outer surface of the inner casing 18, and when the step rear roller 15 comes up to a curved portion leading to the terminal rail 13, the step rear roller 15 begins turning around and closely attached to an inner surface of the outer casing 19.

However, the above-described conventional terminal rail 13 has a disadvantage, in that during operation of the escalator, the step rear roller 15 at the upper or lower end portion of the escalator hits onto the inner surface of the outer casing 19 therein, thereby resulting in serious noise and vibration.

The noise and vibration being caused by such impact has been one of the most desperate problems that the conventional escalator has yet to solve, and despite continuous efforts so far made to overcome such a disadvantage, the noise and vibration still remain annoying.

In recent years, in an effort to unveil the cause of such noise and vibration, there has been carried out a noise measurement experiment employing a Taguchi experimental method which considers all the possible noise factors.

FIG. 5 illustrates the effects of respective noise generating factors under the Taguchi method, wherein the steeper the slope of any of the factors in the graph, the more effective it is to restrain from noise occurrence.

The experiment has revealed that the cause of noise and vibration occurring when the step 9 turns around at the upper and lower end portion of the escalator, is directed to the terminal rail 13. Meanwhile, it is also proved that "C" factors as shown in FIG. 5 have relation to increase or decrease of the impact-caused noise and vibration simply resulting from an impact caused by the step rear roller 15.

Here, minium (red lead) is employed in order to discover noise mechanism and location being impacted thereon with regard to the terminal rail 13, and as shown in FIG. 6, the step rear roller 15 travels along the outer surface of the semicircular inner casing 18 of the terminal rail 13 and is deviated off from a curve start point B of the outer surface of the inner casing 18. Then, the step rear roller 15 is impacted on a portion A (spaced about 45 degrees upwardly from an imaginary line extended from a horizontal surface line of the inner casing 18) of the inner surface of the outer casing 19 of the terminal rail 13, and turned around on and along the inner surface of the outer casing 19 of the terminal rail 13.

The step rear roller 15 does not initially touch a portion of the inner surface of the outer casing 19 corresponding to an imaginary line extended from the portion B but touches a slightly more upward portion of the inner surface of the outer casing 19 than the imaginary line extended from the portion B. This is because the step front roller 14 is driven forwardly in conjunction with the terminal gear 8 and a driving force occurring when the step 9 is being lifted is applied thereto. Also, in accordance with the experimental result with regard to the cycle of the step rear roller 15 being moved in accordance with the guide of the terminal rail 13, it is known that pressure and impact have significantly influenced the outer casing 19 of the terminal rail 13.

Because the cycle of the step rear roller 15 remains constant, the step rear roller 15 renders repeated impacts on the portion A of the terminal rail 13, thereby generating serious noise and vibration.

Also, the step rear roller 15 travelling along the conventional terminal rail 13 springs up from the curve start point B to the portion A of the outer casing 19 while proceeded along the semicircular inner casing 18 of the terminal rail 13.

In short, the conventional terminal rail system for an escalator has several disadvantages, wherein: the step rear roller 15 generates a significant amount of noise each time the step rear roller 15 is impacted on the portion A; each moment the step rear roller 15 is impacted on the portion A at an average rate of 0.8 sec/step, the thusly amplified pulsation increases vibration of the steps 9; the step rear roller 15 and the terminal rail 13 are directly impacted on each other, thereby resulting in decreased longevity of each thereof; the rougher the inner surface of the outer casing 19, the larger becomes the noise; and in order to decrease the noise and vibration being caused by the impact of the step rear roller 15 on the portion A, the gap between the semicircular inner casing 18 and the outer casing 19 may be obtained by a precise fabrication thereof, thereby resulting in increased cost and decreased productivity in fabrication and assembly thereof.

SUMMARY OF THE INVENTION

Accordingly, it is a first object of the present invention to provide a terminal rail system for an escalator capable of decreasing noise and vibration caused by an impact resulting from a step rear roller.

It is a second object of the present invention to provide a terminal rail system for an escalator for reducing vibration of steps in an escalator.

It is a third object of the present invention to provide a terminal rail system for an escalator capable of expanding longevity of each of a step rear roller and a terminal rail.

It is a fourth object of the present invention to provide a terminal rail system for an escalator capable of facilitating terminal rail fabrication and its assembly to an escalator, thereby obtaining an improved productivity and cost reduction.

To achieve the above-described objects, there is provided a terminal rail system for an escalator according to the present invention which includes an escalator step having a step front roller and a step rear roller, an upper guide rail for guiding the step front roller, a lower guide rail for guiding the step rear roller, a semicircular inner casing and outer casing, the inner casing being engaged to the lower guide rail, at a curved portion of the lower guide rail the escalator step changing a proceeding level, and at least one end portion of each of the inner casing and outer casing being separated from a corresponding one thereof for thereby reducing an impact caused by the step rear roller.

DETAILED DESCRIPTION OF THE INVENTION

With reference to the accompanying drawings, a terminal rail system for an escalator in accordance with the present invention will now be described.

Figure 1:
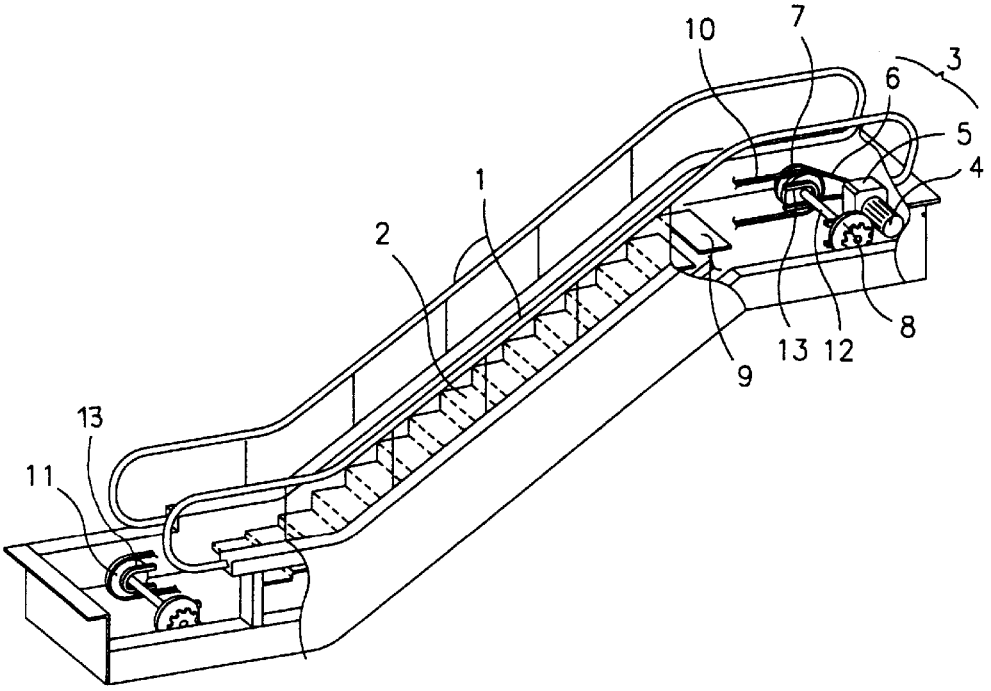
FIG. 1 CONVENTIONAL ART
FIG. 1 is a partially opened perspective view illustrating an internal and external structure of a general escalator.
Figure 2:
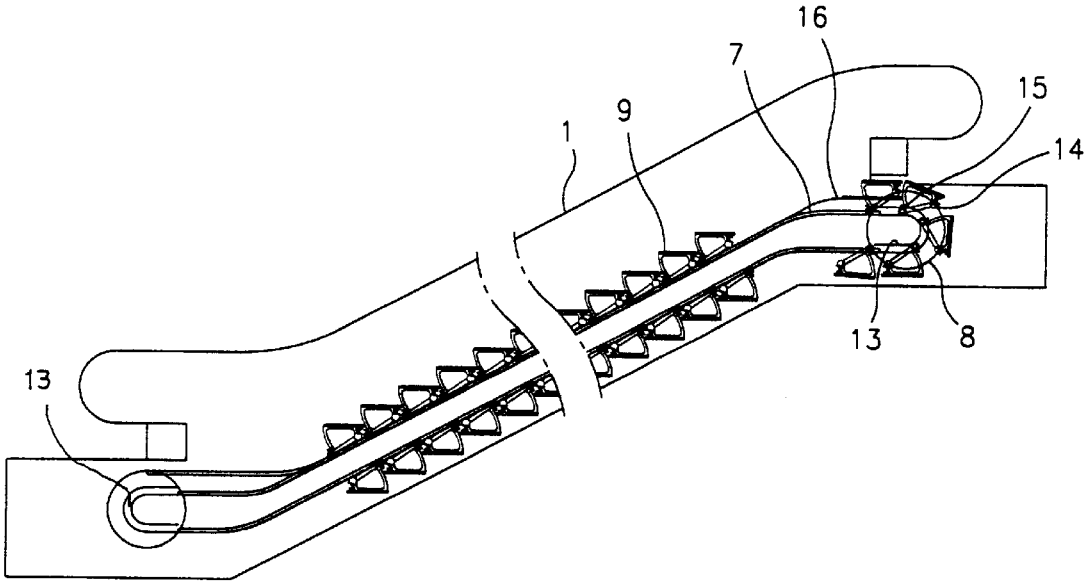
FIG. 2 CONVENTIONAL ART
FIG. 2 is a cross-sectional side view illustrating a step-driving state of the general escalator.
Figure 3:
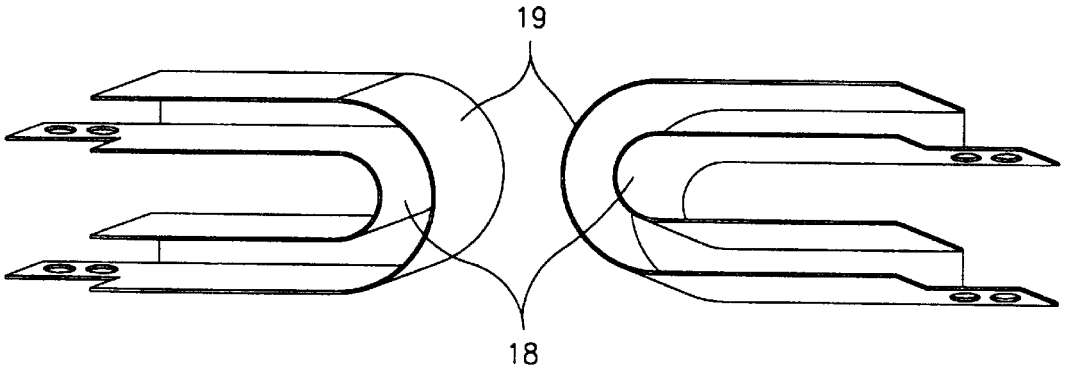
FIG. 3 CONVENTIONAL ART
FIG. 3 is a perspective view illustrating a terminal rail structure for an escalator according to a conventional art.
Figure 4:
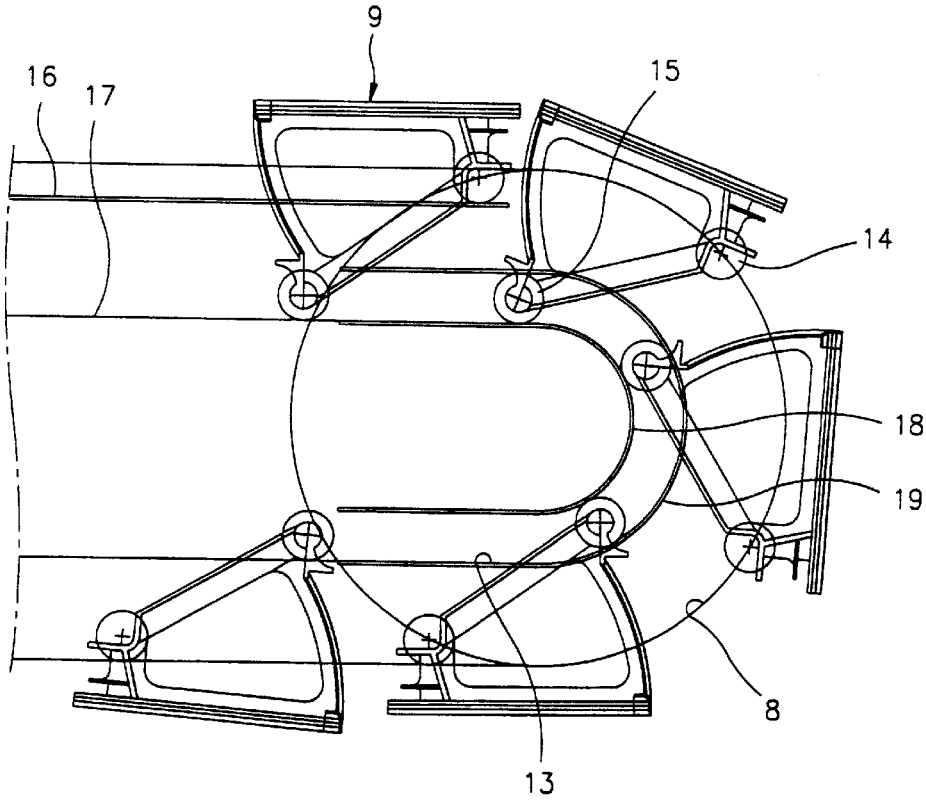
FIG. 4 CONVENTIONAL ART
FIG. 4 is a combination view illustrating the terminal rail combined to a guide rail according to the conventional art.
Figure 5:
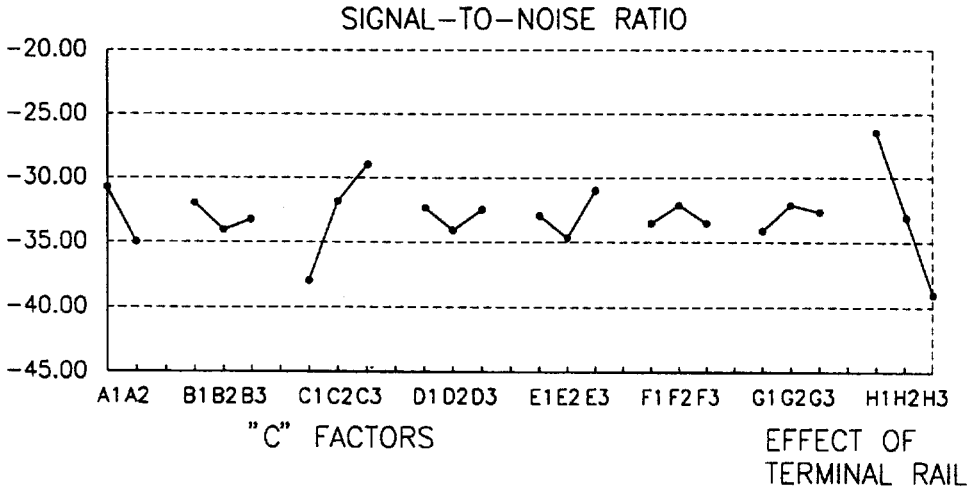
FIG. 5 CONVENTIONAL ART
FIG. 5 is a graph illustrating S/N vibration ratio resultants and effects of noise factors disclosed in accordance with a Taguchi experiment method view according to the conventional art.
Figure 6:
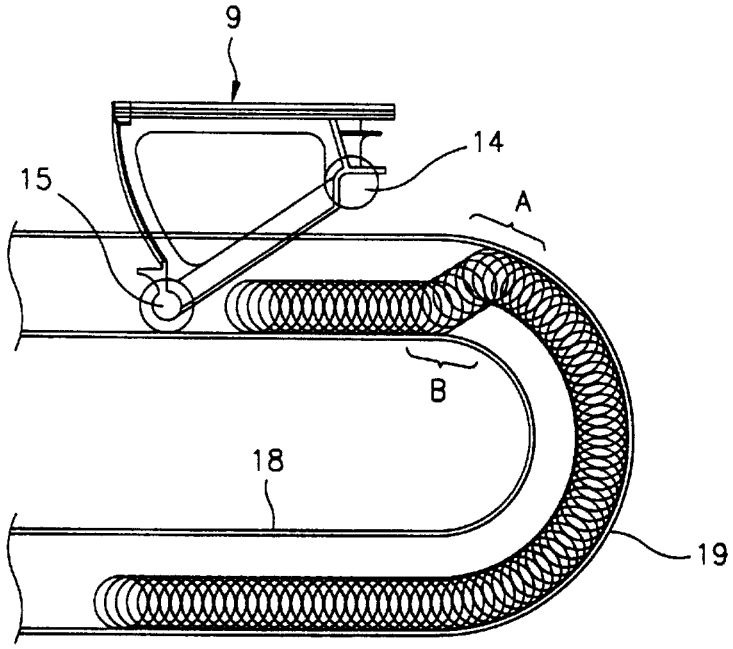
FIG. 6 CONVENTIONAL ART
FIG. 6 is a track variation view illustrating movement of a step rear roller passing along the terminal rail during operation of the conventional terminal rail system for an escalator.
Figure 7:
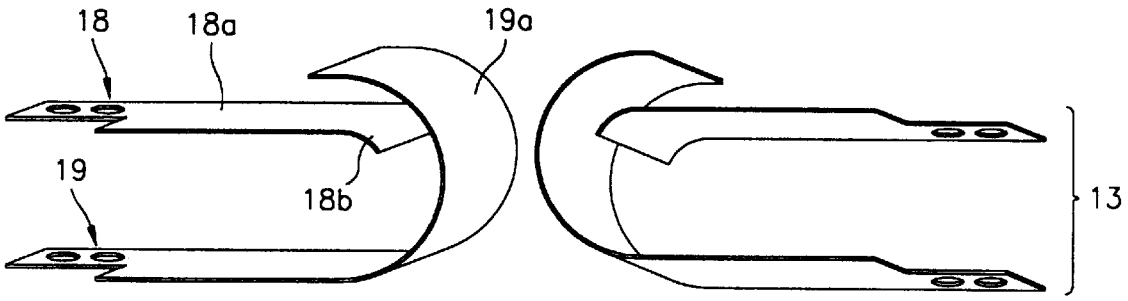
FIG. 7 is a perspective view of a terminal rail structure for an escalator according to the present invention.
Figure 8:
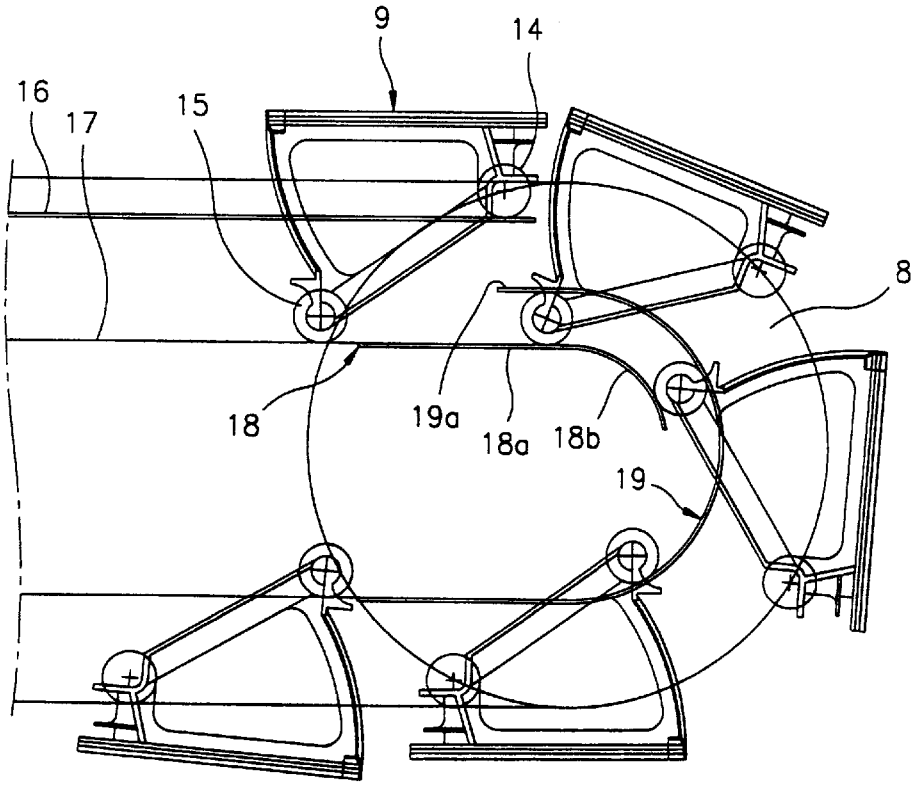
FIG. 8 is a track variation view illustrating movement of a step rear roller passing along the terminal rail engaged to guide rails.
Figure 9:
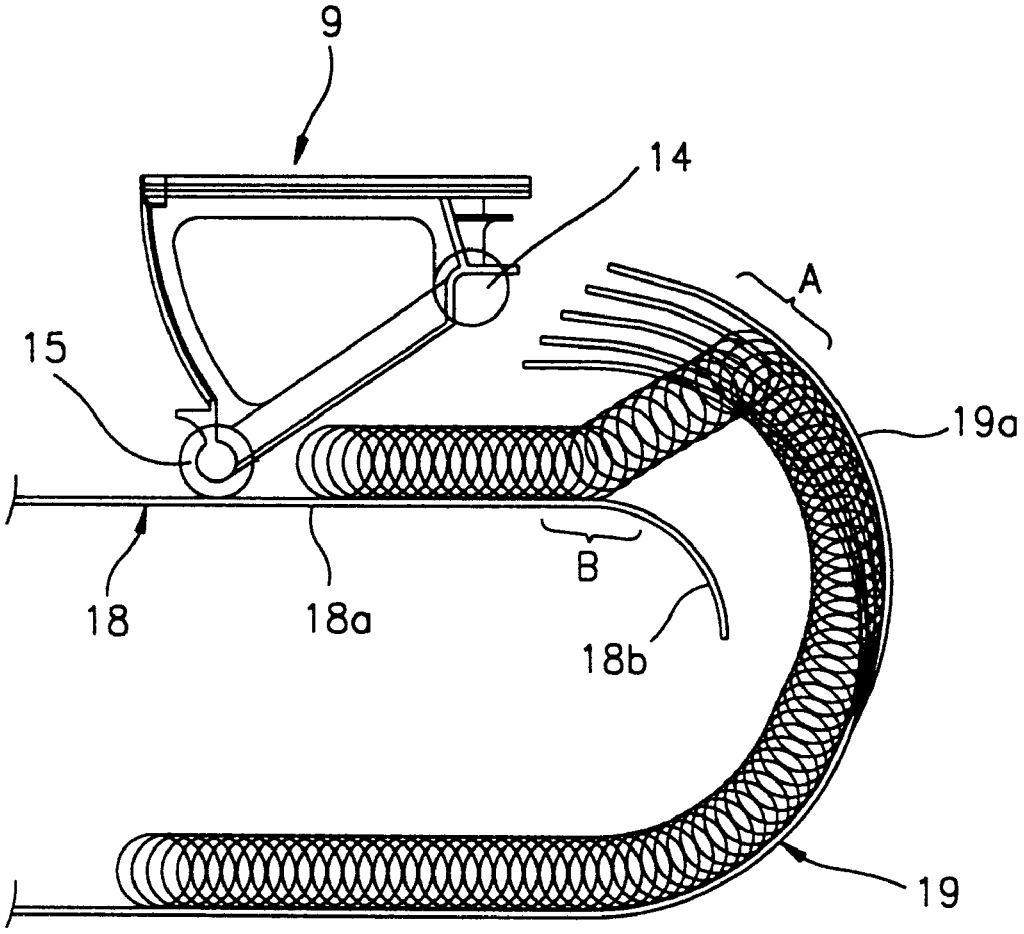
FIG. 9 is a track variation view illustrating movement of a step rear roller passing along the terminal rail during operation of an escalator.

As shown in FIGS. 7 through 9, the terminal rail system for an escalator according to the present invention is divided into an inner casing 18 and a semicircular outer casing 19, and because a predetermined portion of the outer casing 19 is separated from the inner casing 18, an impact caused by a step rear roller 15 being turned round at a curvature of the terminal rail system 13 can be elastically absorbed by the semicircular outer casing 19.

The inner casing 18 includes a horizontal guide portion 18*a* attached to a lower guide rail 17, and a curvature portion 18*b* extendedly curved from the horizontal guide portion 18*a* for preventing the step rear roller 15 from being interrupted during the escalator operation. The semicircular outer casing 19 includes an elastic portion 19*a* having a predetermined thickness at a portion thereof being impacted by the step rear roller 15 for preventing an undesired transformation from occurring therealong. At this time, the curvature of the outer casing 19 is desirable to be identical to that of the conventional art.

Although an interval between the inner casing 18 and the outer casing 19 is generally required to be wider than the diameter of the step rear roller 15 so as to prevent interruption from occurring and affecting other parts of the escalator, the terminal rail system for an escalator according to the present invention is not influenced by the interval because the elastic portion 19*a* of the outer casing 19 and covering over the curvature portion 18*b* of the inner casing 18 is separated and elastically movable. That is to say, even though the interval between the inner casing 18 and the outer casing 19 has a certain plus value (+) or a minus value (−) in comparison to the diameter of the step rear roller 15, when the step rear roller 15 approaches a curved portion of the terminal rail system 13, the step rear roller 15 is elastically and appropriately received into the curvature of the terminal rail system 13, whereby the step rear roller 15 smoothly passed through a channel between the inner casing 18 and the outer casing 19.

The operation of the thusly constituted terminal rail system for an escalator according to the present invention will now be described.

The step front and rear rollers 14, 15 of a step constituting a step chain 10 travel along the upper and lower guide rails 16, 17, respectively, and at a top portion of the escalator, the step rear roller 14 is turned around along the terminal rail system 13. When the step rear roller 15 comes to a direction turning point, that is, the curved portion of the terminal rail system 13, the step rear roller 15 is turned around along the terminal rail 13. At this time, the terminal rail system 13 of the escalator serves to guide the step rear roller 15 so as to follow a predetermined track therein.

FIG. 9 shows an exaggerated track movement view of the step rear roller 15 through a channel of the terminal rail system 13, wherein as shown in FIG. 8, the step front roller 14 travels engaged to the terminal gear 8 and the step rear roller 15 travels along the inner surface of outer casing 19 of the terminal rail system 13.

That is, when the step 9 starts turning on a driving shaft 12 of the terminal gear 8, the step rear roller 15 travels along the outer surface of the inner casing 18 and is impacted on a portion "A" serving as the elastic portion 19*a* of the outer casing 19 so as to buffer the impact caused by the step rear roller 15. At this time, the outer casing 19 of the terminal rail system 13 becomes flexibly elastic against the impact caused by the proceeding step rear roller 15.

Here, the elastic vibration of the outer casing 19 is not visibly noticeable and instead results in a very slight movement, so that the step rear roller 15 is not deviated toward any direction. Also, the impact caused by the step rear roller 15 is sufficiently buffered by the outer casing 19, whereby the step rear roller 15 continues moving along the inner surface of the outer casing 19.

To the contrary, when the escalator travels downwardly, the step rear roller 15 is upwardly moved on and along the inner surface of the outer casing 19 and impacted on a portion "B", that is to say, a curvature portion 18*b* of the inner casing 18. At this time, the inner casing 18 of the terminal rail system 13 is flexibly moved within an elastic scope thereof so as to reduce the impact caused by the step rear roller 15, which in turn continues passing along the curvature portion 18*b*. The step rear roller 15 is loaded onto the horizontal guide portion 18*a* of the inner casing 18 and moved toward the lower guide rail 17.

When an interval between the inner casing 18 and the outer casing 19 is smaller (0) than or equal (0) to the diameter of the step rear roller 15, the outer casing 19 carries out an additional buffering role, for thereby preventing noise and vibration from occurring.

The effects of the thusly operated terminal rail system for an escalator according to the present invention will be described.

When the step rear roller 15 approaches to the curvature portion 18*b* of the inner casing 18 in the terminal rail system 13, and impacted on the outer casing 19, the impact of the step rear roller 15 is applied to the elastic portion 19 of the outer casing 19, so that the elasticity of the outer casing 19 serves to significantly reduce the impact-caused noise and vibration. That is, in the case in which the difference value between the interval of the inner casing 18 and the outer casing 19, and the diameter of the step rear roller 15 remains negative (–), although the step rear roller 15 is alternately operated along a forward and backward direction, the respective impacts caused by the step rear roller 15 are flexibly buffered either by the inner casing 18 or the outer casing 19, thereby considerably relieving the vibration and noise.

Further, the pulsation of the terminal rail system 13 is negligible owing to the removed impact, and when the step unit 2 is boarded by passengers, the step vibration is also remarkably reduced in addition to the extended longevity of the step rear roller 15.

Still further, the fabrication of the terminal rail system 13 is not influenced by a precision degree of dimension tolerance with regard to the interval between the inner casing 18 and the outer casing 19, or by the surface roughness of the step rear roller 15, thereby obtaining facilitated fabrication, reduced cost and improved productivity.

What is claimed is:

1. A terminal rail system for an escalator, comprising:

an escalator step including a step front roller and a step rear roller;

an upper guide rail for guiding the step front roller;

a lower guide rail for guiding the step rear roller;

an inner casing and an outer casing each having an arcuate portion, the inner casing being engaged to the lower guide rail, and said arcuate portion of the outer casing including an elastic portion for reducing an impact caused by the step rear roller.

2. The terminal rail system of claim 1, wherein said arcuate portions of each of the inner casing and the outer casing are separated from a side plate which connects the respective casings so as to elastically absorb an impact against the outer casing occurring when the step rear roller is turned therealong.

3. The terminal rail system of claim 1, wherein the inner casing includes a horizontal guide portion for horizontally guiding the step rear roller and said arcuate portion is extended from the horizontal guide portion so that the step rear roller may easily turn therealong.

4. The terminal rail system of claim 1, wherein a spacing between the inner casing and the outer casing is wider than a diameter of the step rear roller so as to prevent an interruption thereof from occurring toward other parts of the escalator.

5. A terminal rail system for an escalator, comprising:

an escalator step including a step front roller and a step rear roller;

an upper guide rail for guiding the step front roller;

a lower guide rail for guiding the step rear roller;

an inner casing and an outer casing each having an arcuate portion, the inner casing being engaged to the lower guide rail, and said arcuate portion of the inner casing including an elastic portion for reducing an impact caused by the step rear roller.

6. The terminal rail system of claim 5, wherein said arcuate portions of each of the inner casing and the outer casing are separated from a side plate which connects the respective casings so as to elastically absorb an impact against the inner casing occurring when the step rear roller is turned therealong.

7. The terminal rail system of claim 5, wherein the inner casing includes a horizontal guide portion for horizontally guiding the step rear roller and said arcuate portion is extended from the horizontal guide portion so that the step rear roller may easily turn therealong.

8. The terminal rail system of claim 5, wherein a spacing between the inner casing and the outer casing is wider than a diameter of the step rear roller so as to prevent an interruption thereof from occurring toward other parts of the escalator.

* * * * *